US006754362B2

(12) United States Patent
Kaiwa et al.

(10) Patent No.: US 6,754,362 B2
(45) Date of Patent: Jun. 22, 2004

(54) SPEAKER AND SPEAKER SYSTEM

(75) Inventors: Takeshi Kaiwa, Yamagata (JP); Osamu Takahashi, Yamagata (JP); Masanori Ito, Yamagata (JP); Kunio Mitobe, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 55 days.

(21) Appl. No.: 10/056,037

(22) Filed: Jan. 28, 2002

(65) Prior Publication Data

US 2002/0118855 A1 Aug. 29, 2002

(30) Foreign Application Priority Data

Feb. 28, 2001 (JP) ..... 2001-055161

(51) Int. Cl.[7] ..... H04R 1/00
(52) U.S. Cl. ..... 381/397; 381/396; 181/199
(58) Field of Search ..... 381/396, 397, 381/414, 402, 403, 404; 181/198, 199

(56) References Cited

U.S. PATENT DOCUMENTS 5,909,015 A * 6/1999 Yamamoto et al. ..... 181/156
6,243,479 B1 * 6/2001 Proni ..... 381/420
2001/0031063 A1 * 10/2001 Langford et al. ..... 381/397

FOREIGN PATENT DOCUMENTS

JP 08-009493 * 1/1996 ..... H04R/9/02

* cited by examiner

*Primary Examiner*—Curtis Kuntz
*Assistant Examiner*—Brian Ensey
(74) *Attorney, Agent, or Firm*—Sughrue Mion, PLLC

(57) ABSTRACT

There is provided a speaker or a speaker system which has no chance of disabled ventilating air in a space enclosed with a voice coil bobbin to outside of the magnetic circuit through a throughhole C formed in a magnetic circuit to communicate with the space enclosed with a voice coil bobbin, even if mounting a speaker between inner surfaces of a casing, because of enabled ventilating air from a space enclosed with a voice coil bobbin to outside of a magnetic circuit through an air path 3*c* formed in the magnetic circuit to communicate with the throughhole C.

12 Claims, 3 Drawing Sheets

SPEAKER AND SPEAKER SYSTEM

BACKGROUND OF THE INVENTION

1. Field of the Invention

This invention relates to an electrically driven speaker and speaker system used in various audio systems, especially a speaker appropriate to be used for mounting in a casing of a small-size equipment and a speaker system to be constituted with a speaker mounted in a casing.

2. Description of the Related Art

An electrically driven speaker is used generally in various audio systems, up to now. An electrically driven speaker has two types according to magnetic circuit structures, i.e., an outer magnet type and an inner magnet type defined by a magnet position in a magnetic circuit. However, respective vibrating member of two-type speakers has almost same structural relation for a magnetic circuit.

An electrically driven speaker, a half-section shown in FIG. 9, is provided with an outer-magnet-type magnetic circuit comprising an annular top plate 1 having an opening 1*a* in the center, an annular magnet 2 attached to a bottom surface of the top plate 1 and magnetized in a direction of thickness, and a yoke 3 attached to a bottom surface of the magnet 2. The yoke 3 is provided with a bottom plate 3*a*, and a center pole 3*b* projecting from the center of the bottom plate 3*a* and forming a gap G between an inner circular surface of the opening 1*a* in the top plate 1.

In FIG. 9, mark 5 shows a frame attached to a top surface of the top plate 1, mark 6 shows a voice coil supported in the magnetic gap G and vibrating correspondingly to electrical signals, mark 7 shows a cylindrical voice coil bobbin transmitting driving force generated in the voice coil 6 to a vibrating system, mark 8 shows a vibrating member attached to a top edge of the voice coil bobbin 7, mark 9 shows a damper joined at an inner circular portion thereof to an intermediate position of the voice coil bobbin 7 and joined at an outer circular portion thereof to the frame 5, and mark 10 shows a roll-shape edge joined at an inner circular portion to an outer circular portion of the vibrating member 8 and joined at an outer circular portion thereof to the frame 5. The voice coil 6, the voice coil bobbin 7, the vibrating member 8, the damper 9 and the edge 10 constitute a vibration system 12.

In the speaker by prior art, constituted above, a space A enclosed with the cylindrical voice coil bobbin 7; describing in detail, a space A formed by a top surface of the center pole 3*b*, an inner circular surface of the voice coil bobbin 7 and a bottom surface of the vibrating member 8; is ventilated through a thin gap g1 formed by an outer circular surface of the center pole 3*b* and an inner circular surface of the voice coil bobbin 7 to a space B formed by an outer circular surface of the center pole 3*b*, a top surface of the bottom plate 3*a*, an inner circular surface of the magnet 2, and a bottom surface of the top plate 1. Further, the space A is ventilated through a thin gap g2 formed by an inner circular surface of the top plate 1 and an outer circular surface of the voice coil bobbin 6, and a ventilating opening 5*a* provided in the air-permeable damper 9 and in the frame 5 to an outside of the frame 5, i.e. an outside space of the speaker.

When the above structured speaker is inputted with a large power, a large electric current runs in the voice coil 6 so as to be heated. The heat, generated in the voice coil, is transmitted through air of a space between an outer circular surface of the center pole 3*b* and an inner circular surface of the voice coil bobbin 7 to the center pole 3*b*, and transmitted through air of a space between an inner circular surface of the top plate 1 and an outer circular surface of the voice coil 6 to the top plate 1, and then refrigerated. Furthermore, the heat is also refrigerated by air moving in the thin gap g2 formed by an inner circular surface of the top plate 1 and an outer circular surface of the voice coil 6. However, the heat conductivity of air is low and ventilation between the space A and an outside space of the speaker is done through the thin gap g1 formed by an outer circular surface of the center pole 3*b* and an inner circular surface of the voice coil bobbin 7 so that the ventilation is not enough to refrigerate sufficiently the heat of the voice coil 6. Therefore, electric resistance of the voice coil 6 increases by heating and electric current goes down then sound pressure corresponding to electric input can not be given.

On driving a speaker, expansion and compression of air in the space A is repeated. When driving a speaker by low frequency range with a large input, insufficient ventilation of air causes increasing expansion/compression coefficient of air so that restraining the amplitude of the speaker reduces playback sound pressure and causes sound distortion by non-linearity of air compliance.

It is proposed on a speaker to provide a throughhole C, as shown in FIG. 9, through the center of a center pole 3*b*, extending from a top surface of the center pole 3*b* to a bottom surface of a bottom plate 3*a*, communicating between a space A and an outside of a magnetic circuit, to improve releasing heat generated in a voice coil 6 and transmitted to a center pole 3*b* for reducing temperature rising of the voice coil 6 and increasing allowable input power. According to this proposed speaker structure, ventilation between a space A and an outside of a magnetic circuit is done through the throughhole so that the expansion/compression coefficient of air is decreased and then sound distortion by non-linearity of air compliance is restrained.

In an inner-magnet-type magnetic circuit as shown in FIG. 10, a cylindrical magnet 31 is provided on a center of a top surface of a bottom plate 30*a* forming a bottom portion of a bottomed cylindrical yoke 30 and a disk-shaped pole piece 32 forming a magnetic gap G between an inner circular surface of the yoke 30 is joined on the magnet 31. The inner-magnet-type magnetic circuit is provided with a throughhole C through the pole piece 32, the magnet 31 and yoke 30, communicating between a space A and an outside of a magnetic circuit, to improve releasing heat, generated in a voice coil 6 and transmitted to the pole piece 32, for reducing temperature rising of the voice coil 6 and increasing allowable input power so that the expansion/compression coefficient of air is decreased and then sound distortion by non-linearity of air compliance is restrained.

With popularization of a mobile telephone as a small equipment, miniaturization, weight saving, low pricing and higher performance for a mobile phone are required more and technology development regarding the requirements is a mainstream. Study not only on a speaker itself but also a method for mounting a speaker on a casing are required and then a speaker system constituted with a casing applies a structure shown in FIG. 11.

A speaker is shown simply with a vibration system and a magnetic circuit in FIG. 11 and mounted to be held between inner surfaces of a casing 20 by facing a surface of the vibration system 4 and a bottom portion of the magnetic circuit 12 respectively to inner surfaces of the casing 20. Specifically, a sounding surface of the vibration system 4 is placed to abut on an inner surface of a front wall 21, having a sounding opening 21*a*, of the casing 20 and is pressed by an elastic-material-made pad 23 inserted between an inner surface of a rear wall 22, parallel to the front wall 21, of the casing 20 and a bottom surface of the speaker magnetic circuit 12 so that the speaker is mounted and fixed in the casing. In case, pressing the bottom surface of the speaker magnetic circuit 12 directly by the inner surface of the rear wall 22 of the casing 20, as shown in FIG. 12, the speaker is mounted and fixed in the casing.

Objects to be Solved

As mentioned above, a casing for mounting a speaker is miniaturized and a structure which a speaker is mounted in a casing to be held between inner surfaces by facing a surface of a vibration system and a bottom portion of a magnetic circuit respectively to the inner surfaces of the casing, as shown in FIG. 10 or 11, is applied so that a throughhole, formed in a magnetic circuit to communicate with a space enclosed with a voice coil bobbin, is blocked at a bottom portion of a magnetic circuit by the pad 23 or the inner surface of the rear wall 22. Therefore, air in a space A enclosed with a voice coil bobbin can not be ventilated through a throughhole C from a bottom portion of a magnetic circuit 12.

Thereby, the throughhole C can not perform the function to restrain sound distortion by non-linearity of air compliance by improving releasing heat, generated in a voice coil 6 and transmitted to the pole piece 32, for reducing temperature rising of the voice coil 6 and increasing allowable input power.

This invention has been accomplished to overcome the above drawbacks and an object of this invention is to provide a speaker enabled to ventilate air in a space enclosed with a voice coil bobbin to outside of a magnetic circuit through a throughhole formed in the magnetic circuit to communicate with the space even if the speaker is mounted and fixed between inner surfaces in a casing to face a surface of a vibration system and a bottom portion of the magnetic circuit respectively to inner surfaces of the casing.

Another object is to provide a speaker system enabled to ventilate air in a space enclosed with a voice coil bobbin to an outside of a magnetic circuit through a throughhole formed in the magnetic circuit to communicate with the space even if the speaker is mounted and fixed between inner surfaces in a casing to face a surface of a vibration system and a bottom portion of the magnetic circuit respectively to inner surfaces of the casing.

SUMMARY OF THE INVENTION

How to Attain the Object

In order to attain the objects, according to an aspect of this invention, there is provided a speaker which includes a vibration system having a voice coil, a cylindrical voice coil bobbin carrying said voice coil and a vibrating member attached to said voice coil bobbin, and a magnetic circuit generating magnetic force in cooperating with the voice coil to drive said vibrating member, a throughhole formed through said magnetic circuit to communicate with a space enclosed with the voice coil bobbin for ventilating air in said space from a bottom portion of the magnetic circuit; for being used to be fixed between inner surfaces of a casing by facing a surface of the vibration system and a bottom portion of the magnetic circuit respectively to the inner surfaces, and comprises an air path formed in the magnetic circuit to communicate with said throughhole for ventilating air in the space to outside of the magnetic circuit.

In the above-mentioned structure, air in the space enclosed with the voice coil bobbin can be ventilated to outside of the magnetic circuit through the air path formed in the magnetic circuit to communicate with the throughhole for ventilating air in the space from a bottom portion of the magnetic circuit so that air in the space can be ventilated to outside of the magnetic circuit even if the throughhole is blocked by fixing between the inner surfaces of the casing to face the surface of the vibration system and the bottom portion of the magnetic circuit respectively to the inner surface.

According to another aspect of the invention, there is provided a speaker which comprises a speaker as referred to above, wherein said air path is formed in the bottom portion of said magnetic circuit.

In the above-mentioned structure, air ventilation through the air path is kept even if the bottom portion of the magnetic circuit is pressed with any members for fixing between inner surfaces of the casing. So it is no chance that air in the space cannot be ventilated to outside of the magnetic circuit caused by blocking the throughhole.

According to yet another aspect, there is provided a speaker which comprises a speaker as referred to above, wherein said air path is formed, in the bottom portion of the magnetic circuit, extending to an outer edge of the bottom portion of the magnetic circuit.

In the above-mentioned, air ventilation through the air path, formed in the bottom portion of the magnetic circuit extending to an outer edge of the bottom portion of the magnetic circuit, is kept even if the bottom portion of the magnetic circuit is pressed with any members for fixing between inner surfaces of the casing. So it is no chance that air in the space cannot be ventilated to outside of the magnetic circuit caused by blocking the throughhole.

According to further aspect of the invention, there is provided a speaker which comprises a speaker as referred to above, wherein said air path is formed, in the bottom portion of the magnetic circuit, extending to an area of the bottom portion of the magnetic circuit which can not be blocked by the inner surfaces of the casing.

In the above-mentioned structure, air ventilation through the air path, formed in the bottom portion of the magnetic circuit extending to an area of the bottom portion of the magnetic circuit which can not be blocked by the inner surfaces of the casing, is kept even if the bottom portion of the magnetic circuit is pressed with any members for fixing between inner surfaces of the casing. So it is no chance that air in the space cannot be ventilated to outside of the magnetic circuit caused by blocking the throughhole.

According to further aspect of the invention, there is provided a speaker which comprises a speaker as referred to above, wherein said magnetic circuit is outer-magnet-type and said throughhole is formed extending to the bottom portion of the magnetic circuit through a center pole of said magnetic circuit.

In the above-mentioned structure, air ventilation through the air path, formed in the bottom portion of the magnetic circuit, is kept even if the bottom portion of the magnetic circuit is pressed with any members for fixing between inner surfaces of the casing. So it is no chance that air in the space cannot be ventilated to outside of the magnetic circuit caused by blocking the throughhole formed extending to the bottom portion of the magnetic circuit through a center pole of the outer-magnet-type magnetic circuit.

According to further aspect of the invention, there is provided a speaker which comprises a speaker as referred to claim 2, wherein said magnetic circuit is inner-magnet-type and said throughhole is formed extending to the bottom portion of the magnetic circuit through a pole piece and a magnet of said magnetic circuit.

In the above-mentioned structure, air ventilation through the air path, formed in the bottom portion of the magnetic circuit, is kept even if the bottom portion of the magnetic circuit is pressed with any members for fixing between inner surfaces of the casing. So it is no chance that air in the space cannot be ventilated to outside of the magnetic circuit caused by blocking the throughhole formed extending to the bottom portion of the magnetic circuit through a pole piece and a magnet of the inner-magnet-type magnetic circuit.

According to further aspect of this invention, there is provided a speaker system which includes a speaker comprising a vibration system having a voice coil, a cylindrical voice coil bobbin carrying said voice coil and a vibrating member attached to said voice coil bobbin, and a magnetic circuit generating, magnetic force in cooperating with the voice coil to drive said vibrating member, and a casing for receiving said speaker, wherein said speaker is fixed between inner surfaces of said casing by facing a surface of said vibration system and a bottom portion of said magnetic circuit respectively to said inner surfaces, wherein a path is formed in said magnetic circuit to communicate with a space enclosed with the voice coil bobbin for ventilating air in said space from a bottom portion of the magnetic circuit.

In the above-mentioned structure, air in the space enclosed with the voice coil bobbin can be ventilated to outside of the magnetic circuit through the path formed in the magnetic circuit even if the speaker, having a vibration system including a voice coil, a cylindrical voice coil bobbin and a vibrating member, and a magnetic circuit, is fixed between the inner surfaces of the casing by facing the surface of the vibration system and a bottom portion of the magnetic circuit respectively to the inner surface. So it is no chance that air in the space cannot be ventilated to outside of the magnetic circuit.

According to further aspect of the invention, there is provided a speaker system which comprises a speaker system as referred to above, and said path provided with a throughhole formed through said magnetic circuit to communicate with a space enclosed with said voice coil bobbin for ventilating air in said space from a bottom portion of said magnetic circuit, and an air path formed, in the bottom portion of the magnetic circuit, to communicate with said throughhole for ventilating air in said space to outside of the magnetic circuit.

In the above-mentioned structure, air in the space can be ventilated to outside of the magnetic circuit through the throughhole formed through the magnetic circuit for ventilating air in the space from a bottom portion of the magnetic circuit and the air path formed in the bottom portion of the magnetic circuit, to communicate with the throughhole for ventilating air in the space to outside of the magnetic circuit. So it is no chance that air in the space cannot be ventilated to outside of the magnetic circuit.

As mentioned above, there is provided a speaker or a speaker system having no chance of disabled ventilating air in a space enclosed with a voice coil bobbin to outside of the magnetic circuit through a throughhole formed in a magnetic circuit to communicate with the space enclosed with a voice coil bobbin, even if mounting a speaker between inner surfaces of a casing, facing a surface of a vibration system and a bottom portion of a magnetic circuit to inner surfaces of the casing.

Although the present invention has been fully described by way of examples with reference to the accompanying drawings, it is to be noted that various change and modifications can be made with the scope of the present invention. Incidentally, the content of Japanese Patent Application No. 2001-55161 is hereby incorporated by reference.

DESCRIPTION OF THE PREFERRED EMBODIMENT

A speaker and a speaker system, having a speaker in a casing, of embodiments according to this invention will be described with reference to the attached drawings. Parts corresponding to a speaker and a speaker system shown in FIGS. 9–12 are shown with the same marking.

Figure 1A:
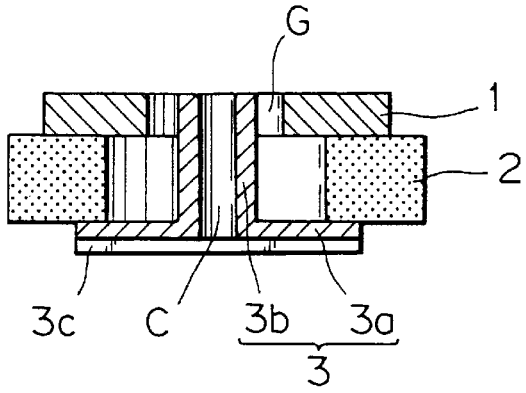
FIG. 1A is a sectional view of an embodiment of an outer-magnet-type magnetic circuit usable for a speaker according to the invention.
Figure 1B:
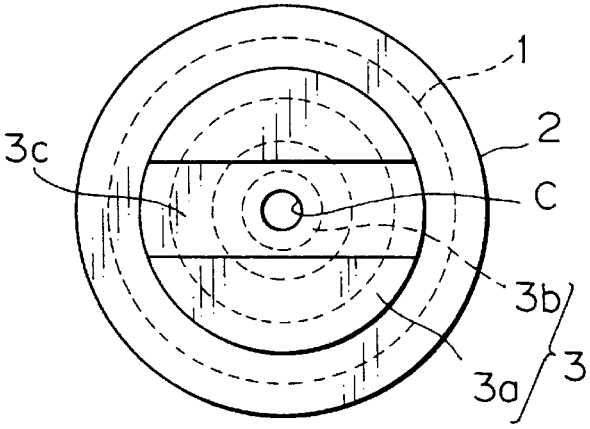
FIG. 1B is a bottom view of an embodiment of an outer-magnet-type magnetic circuit usable for a speaker according to the invention.

FIGS. 1A and 1B show an example of outer-magnet-type magnetic circuits able to be used in a speaker according to this invention. FIG. 1A is a sectional view and FIG. 1B is a bottom view.

In FIG. 1, a groove 3*c* is provided by machining or press working, through a center of a bottom plate 3*a*, extending an outer circular edge of the bottom plate 3*a*, on the bottom surface of the bottom plate 3*a* of a yoke 3 constituting a magnetic circuit. Thereby, the groove 3*c* communicates with a throughhole C through a center of a center pole 3*b*, opened from a top surface of the center pole 3*b* to the center of the bottom surface of the bottom plate 3*a*.

Figure 3:
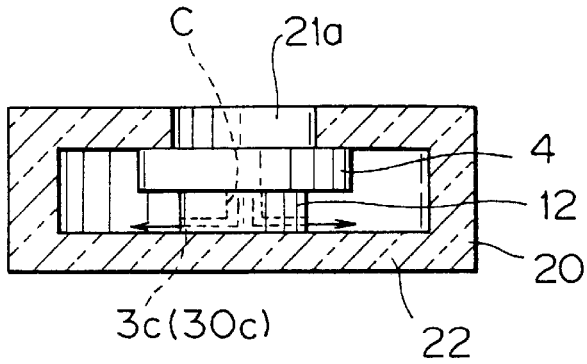
FIG. 3 is a sectional view of other embodiment of a speaker system, according to the invention, which mounts a speaker using the magnetic circuit shown in FIG. 1, in a casing.
Figure 2:
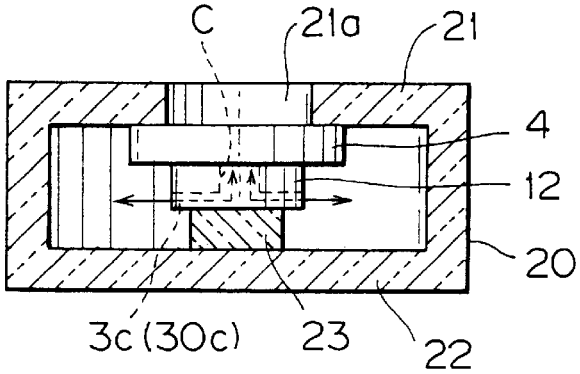
FIG. 2 is a sectional view of an embodiment of a speaker system, according to the invention, which mounts a speaker using the magnetic circuit shown in FIG. 1, in a casing.

Constituting a speaker system to mount a speaker having above structured magnetic circuit in a casing, a sounding surface of a vibration system 4 of a speaker is abutted on an inner surface of a front wall, having a sounding opening 21*a*, of a casing 20 and placed in position and then, a bottom surface of a magnetic circuit 12 of the speaker is pressed by an elastic-material-made pad 23 inserted between an inner surface of a rear wall 22 and the bottom surface of the magnetic circuit 12 as shown in FIG. 2, or pressed directly by an inner surface of the rear wall 22 of the casing 20 as shown in FIG. 3 so that the throughhole C is not blocked. Through an air path formed by the groove 3*c* to communicate with the throughhole C extending to the outer circular edge of the bottom plate 3*a*, air ventilation between outside can be done to exhaust air in a space enclosed with not-shown voice coil bobbin to outside of the magnetic circuit and to take air at outside of the magnetic circuit into the space.

As mentioned above, air ventilation between outside can be done through an air path formed by a throughhole and a groove to exhaust air in a space enclosed with not-shown voice coil bobbin to outside of the magnetic circuit and to take air at outside of the magnetic circuit into the space so that improving releasing heat and reducing temperature rising of the voice coil and increasing allowable input power, the expansion/compression coefficient of air is decreased and then sound distortion by non-linearity of air compliance can be restrained.

Figure 4:
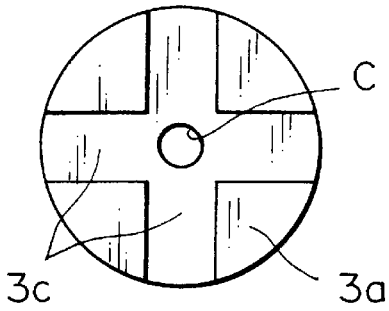
FIG. 4 is a bottom view of an example of a partial modified magnetic circuit shown in FIG. 1.
Figure 5:
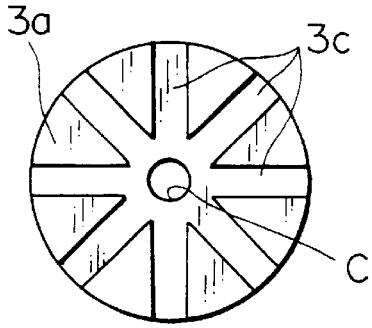
FIG. 5 is a bottom view of other example of a partial modified magnetic circuit shown in FIG. 1.

According to an above-mentioned embodiment, the air path is given by a groove 3*c* formed on the bottom surface of the bottom plate 3*a* by machining or press working, extending an outer circular edge of the bottom plate 3*a* to communicate with the throughhole C. Preferably, the air path may be given with a concave portion provided between a pair of parallel ribs formed projectionaly on the bottom surface of the bottom plate. According to an embodiment in FIG. 1, a groove 3*c* is formed in a straight line extending an outer circular edge of the bottom plate 3*a* through the center thereof. Preferably, the groove may be formed in cross-shape as shown in FIG. 4 or formed in a radial pattern as shown in FIG. 5 to improve air ventilation within the limits of not affecting magnetic function and strength of the yoke 3.

Figure 6A:
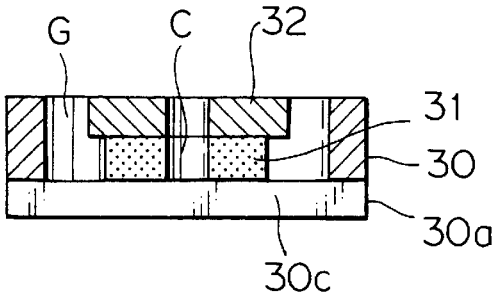
FIG. 6A is a sectional view of an embodiment of an inner-magnet-type magnetic circuit usable for a speaker according to the invention.
Figure 6B:
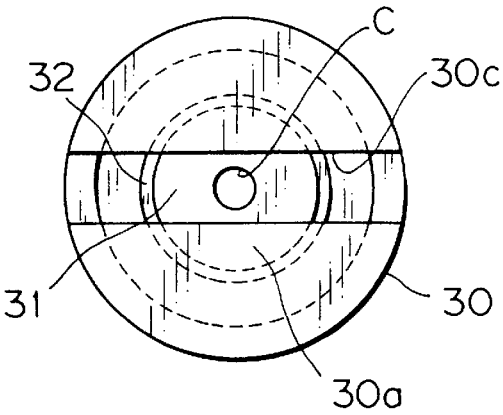
FIG. 6B is a bottom view of an embodiment of an inner-magnet-type magnetic circuit usable for a speaker according to the invention.

FIGS. 6A and 6B show an example of inner-magnet-type magnetic circuits able to be used in a speaker according to this invention. FIG. 6A is a sectional view and FIG. 6B is a bottom view.

In FIG. 6, a slit opening 30*c* is provided by machining or punching before forming cylindrical shape, through a center of a bottom plate 30*a*, extending an outer circular edge of the bottom plate 30*a*, on the bottom surface of the bottom plate 30*a* forming a bottom portion of a bottomed cylindrical yoke 30 constituting a magnetic circuit. Thereby, the slit opening 30*c* communicates in a bottom plate 30*a* with a throughhole C opened through a pole piece 32, a magnet 31 and the yoke 30.

When constituting a speaker system to mount a speaker having above structured magnetic circuit in a casing as mentioned above in FIGS. 2 and 3, the throughhole C is not blocked and air ventilation between outside can be done through an air path formed by the slit opening 30*c* to communicate with the throughhole C and extend to the outer circular edge of the bottom plate 30*a* to exhaust air in a space enclosed with not-shown voice coil bobbin to outside of the magnetic circuit and to take air at outside of the magnetic circuit into the space. Therefore, in the speaker, releasing heat is improved and temperature rising of the voice coil is reduced and allowable input power is increased so that the expansion/compression coefficient of air is decreased and then sound distortion by non-linearity of air compliance can be restrained.

According to an embodiment in FIG. 6, the slit opening 30*c* is formed in a straight line, extending an outer circular edge of the bottom plate 30*a* through the center thereof. Preferably, the slit opening may be formed in cross-shape or a radial pattern as mentioned above in FIGS. 4 and 5 to improve air ventilation within the limits of not affecting magnetic function and strength of the yoke 30.

According to the embodiment of this invention, the slit opening 30*c* is formed on the bottom plate 30*a* to provide a air path having a height as same as a thickness of the bottom plate 30*a* so that the slit opening preferably perform also an air path communicating with a space B, formed around an outer circular surface of the magnet, to improve releasing heat. When allowing an air path having a height thinner than the plate thickness, the air path may be formed in a groove as same as the example in FIG. 1.

Figure 7A:
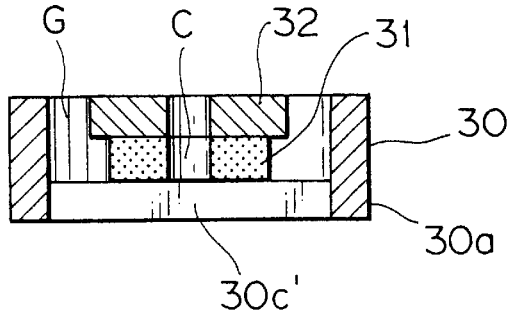
FIG. 7A is a sectional view of an example of a modified inner-magnet-type magnetic circuit shown in FIG. 6A.
Figure 7B:
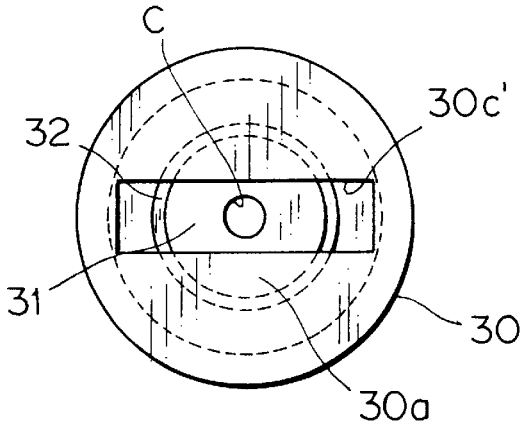
FIG. 7B is a bottom view of an example of a modified inner-magnet-type modified magnetic circuit shown in FIG. 6B.
Figure 8:
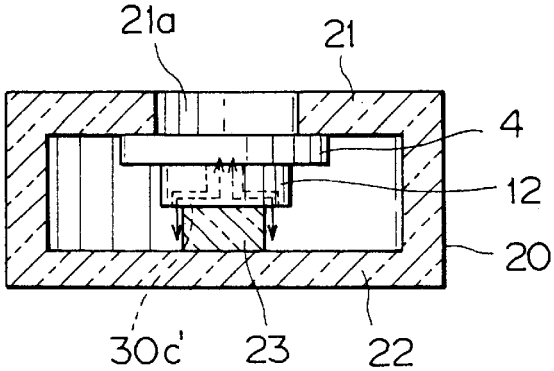
FIG. 8 is a sectional view of an embodiment of a speaker system, according to the invention, which mounts a speaker using the magnetic circuit shown in FIGS. 7A, 7B, in a casing.
Figure 9:
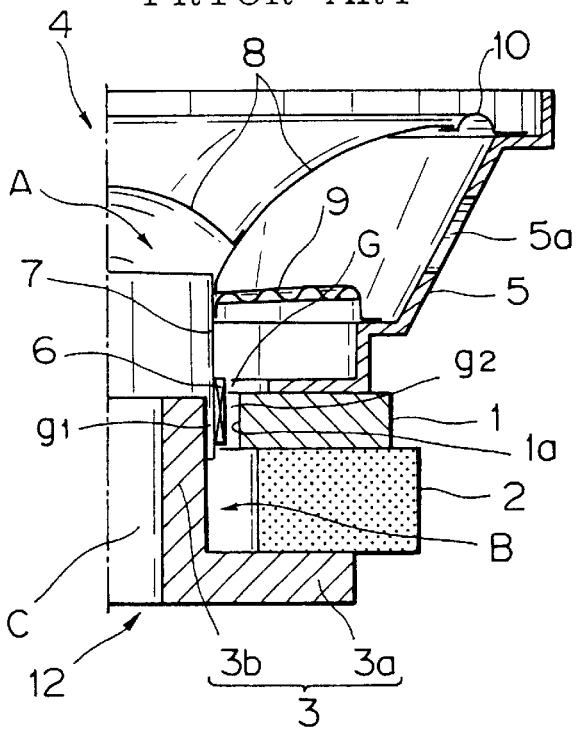
FIG. 9 PRIOR ART
FIG. 9 is a half-sectional view of an example of a speaker by prior art, using an outer-magnet-type magnetic circuit.
Figure 10:
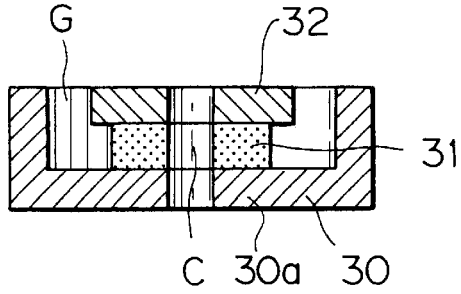
FIG. 10 PRIOR ART
FIG. 10 is a sectional view of an example of a speaker by prior art, using an inner-magnet-type magnetic circuit.
Figure 11:
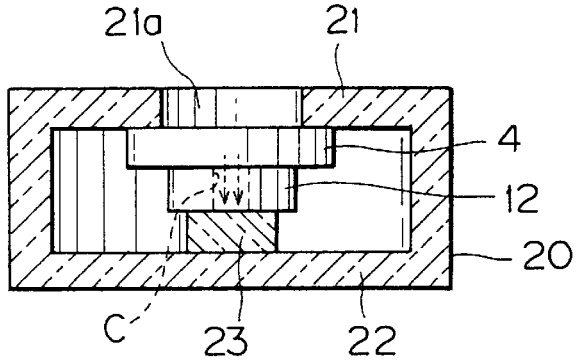
FIG. 11 PRIOR ART
FIG. 11 is a sectional view of an example of a speaker system, by prior art, which mounts a speaker using the magnetic circuit shown in FIGS. 9, 10, in a casing.
Figure 12:
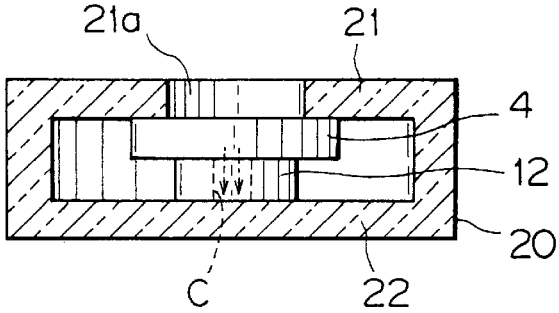
FIG. 12 PRIOR ART
FIG. 12 is a sectional view of other example of a speaker system, by prior art, which mounts a speaker using the magnetic circuit shown in FIGS. 9, 10, in a casing.

According to an embodiment in FIG. 6, the slit opening 30*c* is formed in a straight line, extending an outer circular edge of the bottom plate 30*a* through the center thereof. Preferably, a square opening 30*c*', as shown in FIG. 7, maybe formed to have a larger area than a pad 23 and keep an outer circular edge portion of the bottom plate 30*a* instead of the slit opening 30*c* when the pad 23, inserted between a inner surface of the rear wall 22 and a bottom surface of the magnetic circuit 12 of the speaker for pressing the bottom surface thereof, is enough smaller than an area of the bottom surface of the magnetic circuit 12. Such square opening 30*c*' can be manufactured easier than a slit opening extending to an outer circular edge and also is advantageous to keep strength of a yoke. An air path formed by such square opening 30*c*' faces to a rear surface direction facing to an inner surface of a casing as shown in FIG. 8, opposing above-mentioned embodiment which an air vent is on a side of the magnetic circuit.

In any embodiments mentioned above, an air path is formed in a magnetic circuit to communicate with a throughhole provided in the magnetic circuit to exhaust air in a space enclosed with a voice coil bobbin to outside of the magnetic circuit so that a casing for mounting a speaker can be miniaturized. When mounting a speaker between inner surfaces of a casing by facing a surface of a vibration system and a bottom portion of a magnetic circuit respectively to inner surfaces of the casing, air ventilation between a space enclosed with a voice coil bobbin and outside can be done always. Therefore, in the speaker, releasing heat is improved and temperature rising of the voice coil is reduced and allowable input power is increased so that the expansion/compression coefficient of air is decreased and then sound distortion by non-linearity of air compliance can be restrained.

What is claimed is:

1. A speaker, including a vibration system having a voice coil, a cylindrical voice coil bobbin carrying said voice coil and a vibrating member attached to said voice coil bobbin, and a magnetic circuit generating a magnetic force in cooperation with said voice coil to drive said vibrating member, and a throughhole in communication with a space enclosed by said voice coil bobbin for ventilating air in said space through a bottom portion of the magnetic circuit, for being used by facing a surface of the vibration system and a bottom portion of the magnetic circuit respectively to the inner surfaces of a casing so as to be held therebetween; the speaker further comprising a groove formed across an entire surface of said magnetic circuit in communication with said throughhole operable to ventilate air from said space to an area outside said magnetic circuit.

2. A speaker according to claim 1, wherein said groove is formed on a bottom surface of said magnetic circuit.

3. A speaker according to claim 2, wherein said groove extends to an outer edge of the bottom surface of said magnetic circuit.

4. A speaker according to claim 2, wherein said groove extends to an area of a bottom portion of said magnetic circuit which can not be blocked by the inner surfaces of said casing.

5. A speaker according to claim 2, wherein said magnetic circuit is an outer-magnet-type and said throughhole extends to the bottom portion of said magnetic circuit through a center pole of said magnetic circuit.

6. A speaker according to claim 2, wherein said magnetic circuit is an inner-magnet-type and said throughhole extends to the bottom portion of said magnetic circuit through a pole piece and a magnet of said magnetic circuit.

7. A speaker system comprising;

a speaker comprising a vibration system having a voice coil, a cylindrical voice coil bobbin carrying said voice coil and a vibrating member attached to said voice coil bobbin, a magnetic circuit generating a magnetic force cooperating with the voice coil to drive said vibrating member; and a casing for receiving said speaker, wherein said speaker is held between inner surfaces of said casing by facing a surface of said vibration system and a bottom portion of said magnetic circuit respectively to said inner surfaces, wherein a path is formed across an entire surface of said magnetic circuit to communicate with a space enclosed by the voice coil bobbin, said path operable to ventilate air in said space through a bottom surface of the magnetic circuit.

8. A speaker system according to claim 7, wherein said path comprises:

a throughhole formed through said magnetic circuit; and a groove formed on the bottom surface of the magnetic circuit to communicate with said throughhole for ventilating air from said space to outside of the magnetic circuit.

9. A speaker comprising:

a vibration system comprising a voice coil and a voice coil bobbin, the voice coil bobbin comprising a first air space;

a magnetic means for creating a magnetic field in close proximity of said vibration system;

a casing enclosing said vibration system and said magnetic means, said casing comprising a front wall with a sound opening therein and a rear wall; and a groove formed on a rear surface of the magnetic means, said groove configured adjacent the rear wall of said casing, wherein said groove is operable to ventilate air between a second air space within said casing and the first air space, wherein said groove extends across an entire surface of said magnetic means.

10. A speaker as set forth in claim 9, further comprising an elastic device disposed between said magnetic means and the rear wall of said casing, said elastic device being operable to hold the magnetic means and said vibration system against the front wall of said casing.

11. A speaker as set forth in claim 10, wherein said groove is configured adjacent a front surface of said elastic device.

12. A speaker as set forth in claim 7, wherein the path formed on a surface of said magnetic circuit is a rectangular opening formed entirely within the periphery of the magnetic circuit.

* * * * *